US005366020A

United States Patent [19]

Berzin et al.

[11] Patent Number: 5,366,020

[45] **Date of Patent: * Nov. 22, 1994**

[54] REINFLATABLE EXTERNAL CASTING PACKER AND METHOD OF CASING

[75] Inventors: Vel Berzin; John R. Abarca, both of Houston, Tex.

[73] Assignee: Baker Hughes Incorporated, Houston, Tex.

[ * ] Notice: The portion of the term of this patent subsequent to Apr. 13, 2010 has been disclaimed.

[21] Appl. No.: 46,429

[22] Filed: Apr. 12, 1993

Related U.S. Application Data

[62] Division of Ser. No. 788,349, Nov. 6, 1991, Pat. No. 5,201,369.

[51] Int. Cl.[5] ..... E21B 33/127

[52] U.S. Cl. ..... 166/387; 166/187; 277/34.6

[58] Field of Search ..... 166/387, 285, 187; 277/34.6

[56] References Cited

U.S. PATENT DOCUMENTS

| | | | |
|---|---|---|---|
| 3,053,322 | 9/1962 | Kline | 166/187 X |
| 3,437,142 | 4/1969 | Conover | 166/277 |
| 4,082,298 | 4/1978 | Sanford | 277/34.3 |
| 4,260,164 | 4/1981 | Baker et al. | 277/34 |
| 4,402,517 | 9/1983 | Wood et al. | 277/34 |
| 4,474,380 | 10/1984 | Carter, Jr. | 277/34.6 |
| 4,527,625 | 7/1985 | Wood et al. | 166/187 |
| 4,586,526 | 5/1986 | Reardon | 137/70 |
| 4,653,588 | 3/1987 | White | 166/374 |
| 4,714,117 | 12/1987 | Dech | 166/380 |
| 4,869,325 | 9/1989 | Halbardier | 166/387 |
| 4,962,812 | 10/1990 | Berzin | 166/187 |
| 5,186,258 | 2/1993 | Wood et al. | 166/387 |
| 5,190,109 | 3/1993 | Pardo | 166/387 |
| 5,201,369 | 4/1993 | Berzin et al. | 166/187 |

FOREIGN PATENT DOCUMENTS

| | | |
|---|---|---|
| 0146324 | 6/1985 | European Pat. Off. . |
| 0178835 | 4/1986 | European Pat. Off. . |
| 0214851 | 3/1987 | European Pat. Off. . |
| 0275612 | 7/1988 | European Pat. Off. . |
| WO91/05134 | 4/1991 | WIPO . |

*Primary Examiner*—Hoang C. Dang
*Attorney, Agent, or Firm*—Melvin A. Hunn; Mark W. Handley

[57] ABSTRACT

The present invention is directed to a reinflatable external casing packer which is operable in three modes, including: a filling mode of operation, a locking mode of operation, and a reinflation mode of operation. A valve system is provided which allows for selective filling and reinflation of the external casing packer in response to suspected or detected loss of pressure within the inflation chamber. The present invention may also be characterized as a method of placing a wellbore.

26 Claims, 11 Drawing Sheets

REINFLATABLE EXTERNAL CASTING PACKER AND METHOD OF CASING

RELATED APPLICATIONS

This patent application is a divisional patent application of U.S. patent application Ser. No. 07/788,349, which was filed on Nov. 6, 1991, entitled "Reinflatable External Casing Packer and Method of Casing, now U.S. Pat. No. 5,201,369, and invented by Vel Berzin and John R. Abarca, both of Houston, Tex., from which the present application claims the priority of the filing date under 35 U.S.C. & 121.

BACKGROUND OF THE INVENTION

1. Field of the Invention

This invention relates generally to inflatable wellbore packers, and specifically to external casing packers as well as a method of casing an openhole wellbore.

2. Description of the Prior Art

External casing packers are wellbore packing devices which are coupled into a string of casing. Preferably, the external casing packer includes a mandrel which defines a central bore which is substantially similar in internal diameter to that of the central bore of the casing string. A packing element is disposed radially outward from the mandrel, and serves to grippingly and sealingly engage a wellbore surface, such as an openhole wellbore wall.

External casing packers are used in conjunction with casing cement as a means for securing the casing string in a desired position within the wellbore, but can also be used in lieu of cement in certain applications. In such applications, the external casing packer is intended to remain in an inflated setting position for the uses life of the oil and gas well, which can be substantial periods of time.

One type of external casing packer includes an annular inflatable wall disposed about the mandrel of the external casing packer, which in-part defines an inflation chamber. Pressurized wellbore fluid is directed into the inflation chamber, which serves to receive pressurized fluid which outwardly radially expands the annular inflatable wall from an uninflated running mode of operation to an inflated setting mode of operation.

The prior art external casing packers are susceptible to two problems, each of which could result in catastrophic loss within the wellbore. The first problem is that the annular inflatable wall which is radially expanded outward in response to pressurized wellbore fluid is usually at least in-part composed of rubber. Typically, the annular gamble wall includes an inner annular elastomeric sleeve which is covered on its exterior surface by protective material to prevent puncture of the elastomeric sleeve. After setting, the material which comprises the elastomeric sleeve is susceptible to "cold flowing". This could cause a change in pressure exerted against the annular inflatable wall, which could cause the external casing packer to release from gripping and sealing engagement with the wellbore wall, resulting in shifting of the casing string within the openhole wellbore or creation of a leak path around the packer. The second problem is that the inflation chamber of the external casing packer may include tiny leak paths which, over time, result in a loss of pressure from the inflation chamber, and corresponding loss of sealing engagement between the external easing packer and the openhole wellbore wall, also resulting in shifting of the casing string or creation of a leak path around the packer.

SUMMARY OF THE INVENTION

It is one objective of the present invention to provide an external casing packer which is operable in a plurality of modes, including a reinflation mode which can be selectively entered in order to reinflate the packer to remedy a loss of pressure due to cold flowing of the material which forms the packer's inflatable wall, or due to leakage of fluid from a packer inflation chamber.

It is another objective of the present invention to provide an external casing packer which is operable in a plurality of modes, and which further includes a locking mode of operation in which a valving system in the packer closes to prevent both the entry and release of inflation fluid from the inflation chamber to prevent damage to the inflatable wall from over-inflation and to prevent leakage of inflation fluid from the inflation chamber when the packer is in an inflated setting position in gripping engagement with the wellbore wall.

It is another objective of the present invention to provide a method of casing a wellbore in which a tubular casing string and at least one inflatable packer are provided and coupled together, and placed in a desired location within the wellbore, wherein the inflatable packer is inflated into gripping and sealing engagement with the openhole wellbore, and used to isolate zones adjoining the tubular casing string in the openhole wellbore, and wherein the inflatable packer is selectively reinflated in response to the detected loss of pressure within the inflation chamber.

These objectives are achieved as is now described. Characterized as an apparatus, the present invention is an inflatable packer for use in a wellbore, when coupled to a wellbore tubular conduit which passes pressurized fluid through a central bore, for mating against a wellbore surface. The inflatable packer includes an inflatable wall disposed exteriorly of the wellbore tubular conduit and at least in-part defining an inflation chamber. A valve system is provided for selectively directing pressurized fluid from the central bore of the tubular conduit to the inflation chamber. The valve system is operable in at least three modes, including a filling mode of operation, a locking mode of operation, and a reinflation mode of operation. During a filling mode of operation, the valve system directs pressurized fluid into the inflation chamber to outwardly radially expand the inflatable wall from a running position in which the inflatable wall is out of contact with the wellbore surface to a setting position in which the inflatable wall is in gripping and sealing engagement with the wellbore surface. In the locking mode of operation, the valve system closes to prevent the entry and release of pressurized fluid from the inflation chamber to prevent damage to the inflatable wall from over-inflation and to maintain the setting position with the inflatable wall in gripping and sealing engagement with the wellbore surface. In a reinflation mode of operation, the locking mode of operation is overridden and pressurized fluid is directed into inflation chamber to compensate for loss of pressure in the inflation chamber.

When characterized as a method, the present invention is a method of casing a wellbore, which includes a number of method steps. A tubular casing string is provided, which defines a central casing bore having an internal casing diameter, for placement in the openhole wellbore. At least one inflatable packer is provided, each of which includes a mandrel which defines a central packer bore having an internal mandrel diameter substantially similar to the internal casing diameter of the tubular casing string. An inflatable wall is disposed exteriorly of the mandrel and at least in-part defines an inflation chamber disposed exteriorly of the mandrel. A valve system is provided for selectively directing pressurized fluid from the central packer bore of the mandrel to the inflation chamber. The tubular casing string and at least one inflatable packer are coupled together, and placed in a selected location within the openhole wellbore. Wellbore fluid is directed through the valve system of each of the inflatable packers into the inflation chambers. Each annular inflatable wall is inflated, causing each inflatable packer to expand radially outward from the mandrel into gripping and sealing engagement with the openhole wellbore. The valve system is closed to prevent deflation of the inflatable packer. Selected subterranean zones may be isolated, at least in-part through the gripping and sealing engagement of the openhole wellbore by the inflatable wall of each of the inflatable packers. Finally, wellbore fluid is selectively directed through the valve system of selected ones of the inflatable packers to reinflate the inflatable walls in response to loss of pressure within the inflation chamber.

The above as well as additional objects, features, and advantages of the invention will become apparent in the following detailed description.

BRIEF DESCRIPTION OF THE DRAWING

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
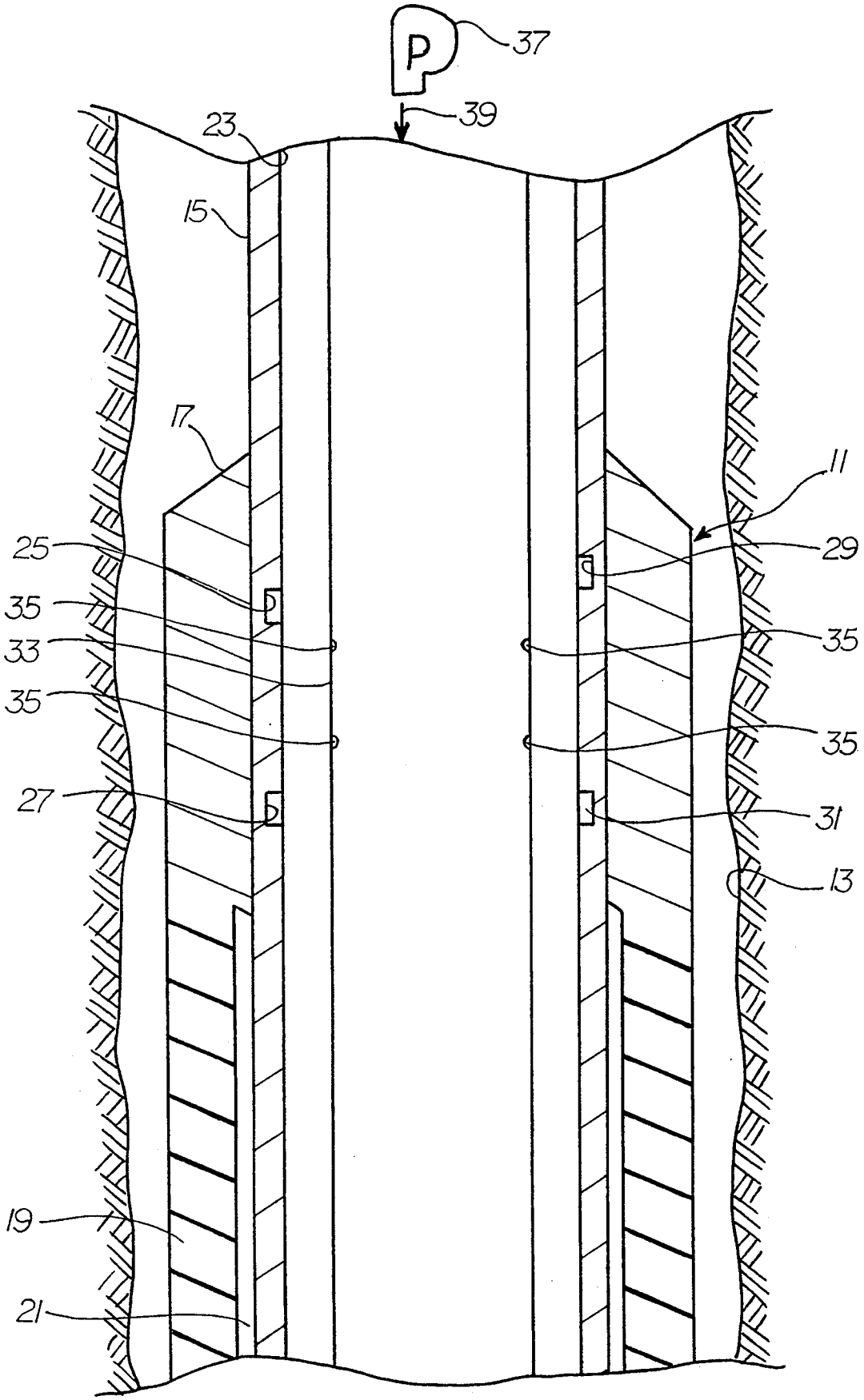
FIGURE 1 PRIOR ART
FIG. 1 is a simplified and fragmentary view of a prior art external casing packer disposed in an openhole wellbore in an uninflated state, in full longitudinal section view.

FIG. 1 is a fragmentary longitudinal section view of a prior art external casing packer 11, shown in simplified form, in a running mode of operation, disposed within openhole wellbore 13. External casing packer 11 includes cylindrical mandrel 15, which is preferably coextensive at its internal diameter with the internal diameter of a casing string. Upper and lower collars 17, 18 (only upper collar 17 is shown in FIG. 1) are coupled to the upper and lower ends of mandrel 15. Preferably, a valving system is provided internally within upper collar 17. An annular inflatable wall 19 is disposed between upper and lower collars 17, 18, and preferably is formed at least in-part of an elastomeric material, which is deformable radially outward in response to fluid pressure, and urged into gripping and sealing engagement with openhole wellbore 13.

Inflation chamber 21 is disposed between mandrel 15 and annular inflatable wall 19, and serves-to-receive pressurized fluid from the casing string. Specifically, valve ports 25,27,29,31 serve to receive wellbore fluid, which is represented graphically by arrow 39, from pump 37 which is located either at the surface or within wellbore 13. Pressurized wellbore fluid may be directed downward within mandrel 15 through tubular workstring 33 (and outward through ports 35), or through the central bore of the casing string itself. In either event, pressurized fluid is directed into upper collar 17 through valve ports 25, 27, 29, 31, and into inflation chamber 21.

Of course, the prior art external casing packer of FIG. 1 is shown in greatly simplified form. For example, for purposes of clarity, the coupling between upper collar 17 and annular inflatable wall 19 is not shown in FIG. 1. Furthermore, in the prior art devices, annular inflatable wall 19 includes reinforcing materials, and an external protective coating which prevents the accidental puncture of annular inflatable wall 19. However, for purposes of clarity and simplicity of explanation, FIG. 1 shows a vastly simplified external casing packer. U.S. Pat. No. 3,437,142, entitled *Inflatable Packer for External Use on Casing and Liners and Method of Use*, which issued on Apr. 8, 1969, to G.E. Conover, describes and depicts in greater detail the mechanical features of prior art external casing packers, and is incorporated herein by reference as if fully set forth.

Figure 2A:
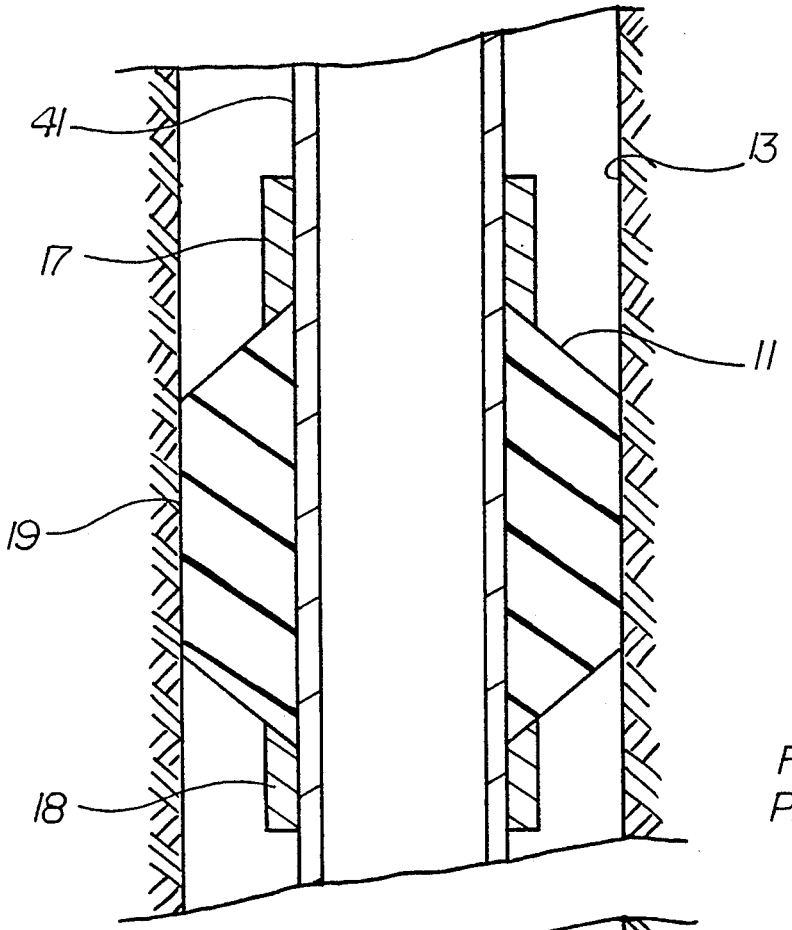
FIGURE 2a PRIOR ART
FIG. 2*a* is a longitudinal section view of the prior an external casing packer of FIG. 1, in an inflated state and in gripping and sealing engagement of the openhole wellbore.
Figure 2B:
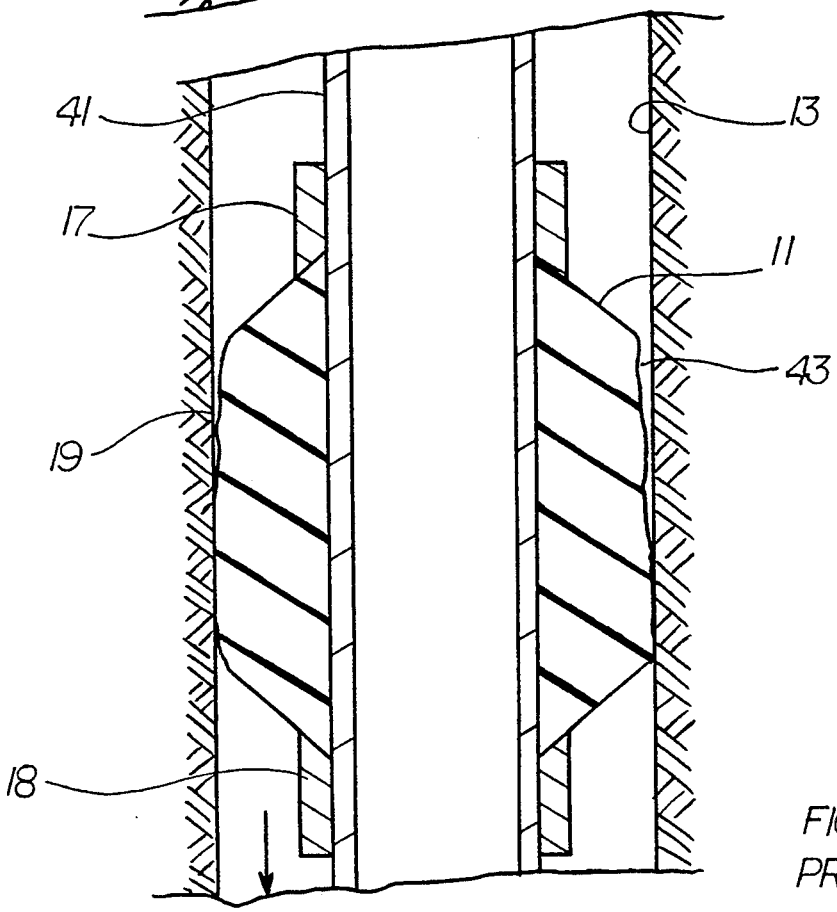
FIGURE 2b PRIOR ART
FIG. 2*b* is a longitudinal section view of the prior art external casing packer of FIGS. 1 and 2*a* in an inflated state, but no longer in gripping and sealing engagement with the openhole wellbore due to leakage of fluid from said external casing packer.

FIGS. 2*a* and 2*b* are longitudinal section views of the prior art external casing packer of FIG. 1 in inflated and semi-inflated states, respectively. As shown, external casing packer 11 is disposed within openhole wellbore 13, with annular inflatable wall 19 in an inflated condition.

In FIG. 2*a*, annular inflatable wall 19 is fully inflated, and in gripping and sealing engagement with openhole wellbore 13. As discussed above, prior art external casing packers are susceptible to both cold flowing of the elastomeric materials which at least in-part form annular inflatable wall 19, and leakage of wellbore fluid from the inflation chamber 21 (not depicted in FIGS. 2*a* and 2*b*). As shown in FIG. 2*b*, loss of wellbore fluid from inflation chamber 21, or cold flowing of the elastomeric material of annular inflatable wall 19; results in annular inflatable wall 19 coming out of gripping and sealing engagement with openhole wellbore wall 13. As a consequence, casing string 41 may leak. The improved external casing packer of the present invention addresses these problems found in the prior art devices.

Figure 3A:
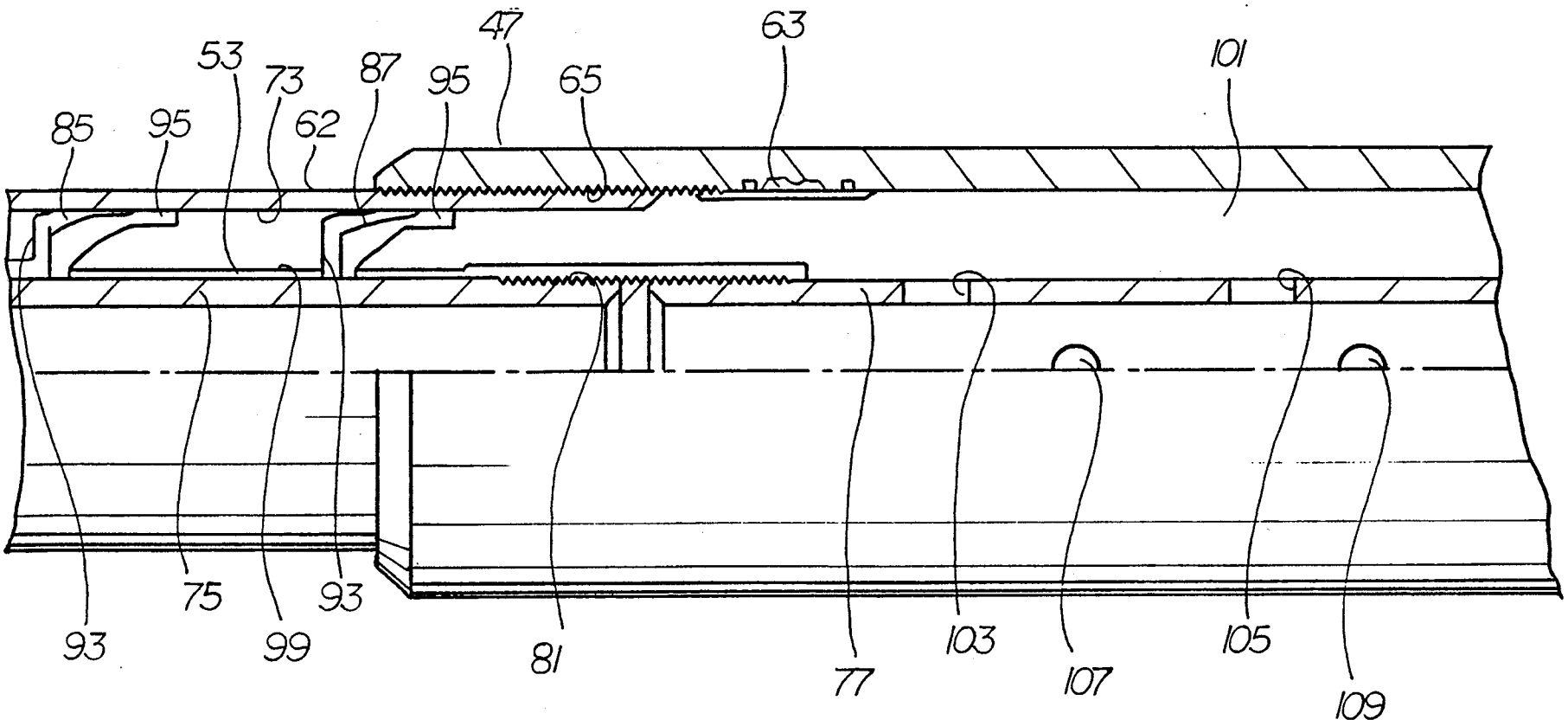
FIGS. 3*a*, 3*b*, and 3*c* are one-quarter longitudinal section views of the preferred reinflatable external casing packer of the present invention with a workstring disposed therein in a configuration suited for inflation of the external casing packer during a filling mode of operation.
Figure 3B:
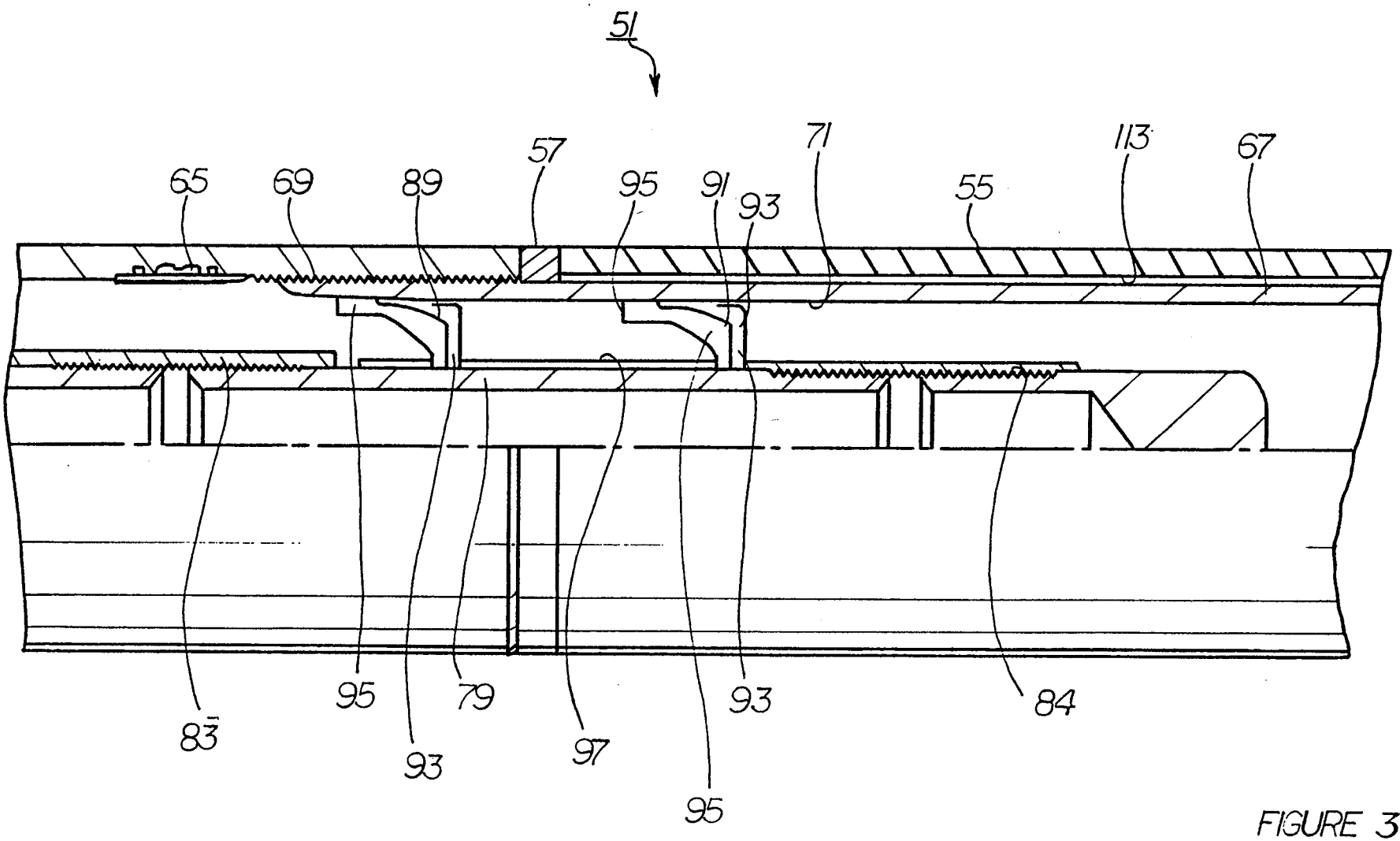
Figure 3D:
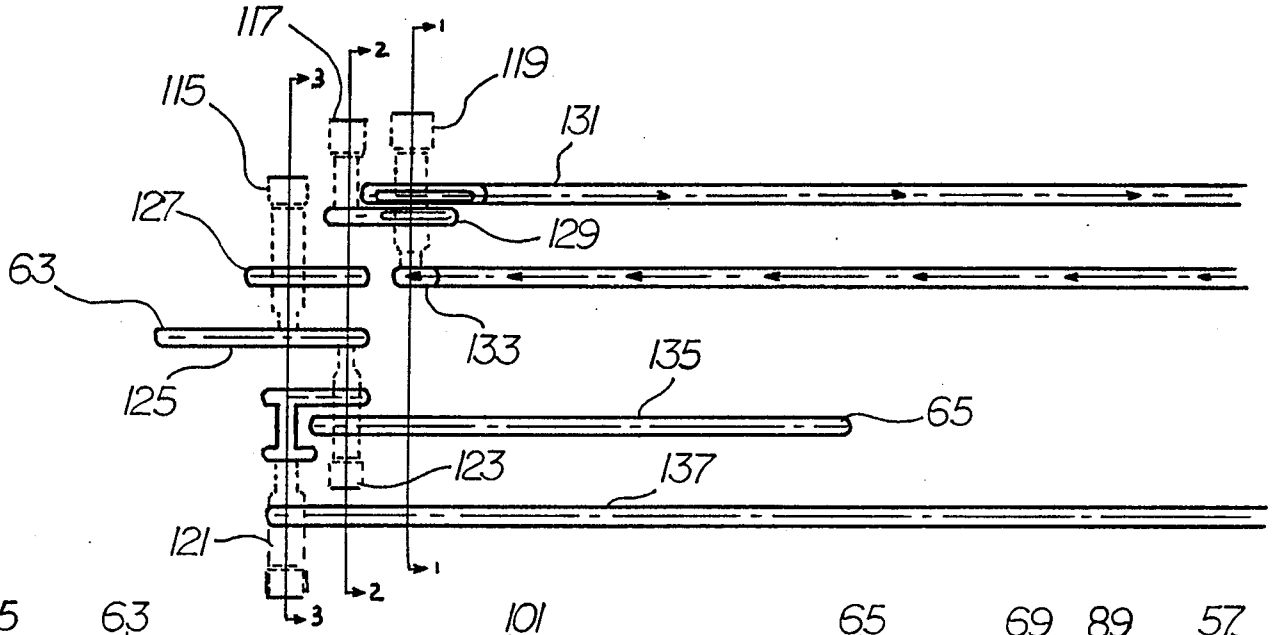
FIG. 3*d* is a schematic view of the valve system of the preferred external casing packer of the present invention.
Figure 3C:
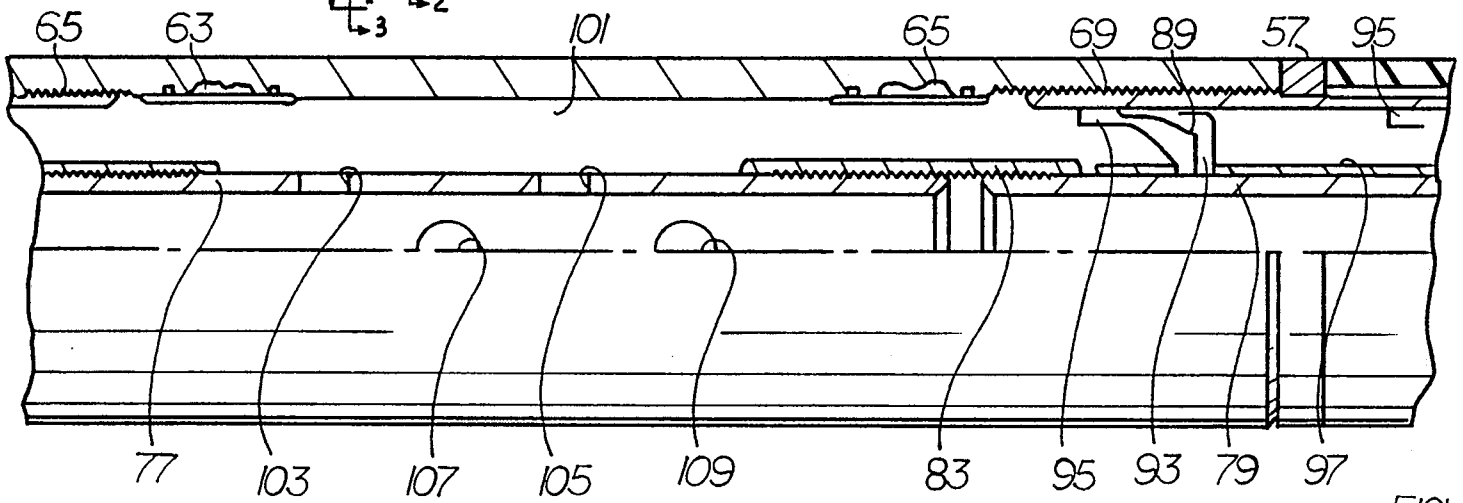

FIGS. 3*a*, 3*b*, and 3*c* are one-quarter longitudinal views showing upper collar 47 of external casing packer 51 of the present invention with a workstring 53 disposed therein. FIGS. 3*a*, 3*b*, and 3*c* show external casing packer 51 and workstring 53 disposed in a configuration which is suited for inflation of annular inflatable wall 55 during a filling mode of operation. To simplify this description, and for purposes of clarity, annular inflatable wall 55 is shown in simplified form as a single elastomeric layer. In addition, coupling 57 between upper collar 47 and annular inflatable wall 55 is also shown in simplified form. Both annular inflatable wall 55 and coupling 57 are significantly more complicated in structure and form, and are substantially similar to the inflatable wall and coupling shown in U.S. Pat. No. 3,437,142, entitled *Inflatable Packer for External Use on Casing and Liners and Method of Use*, which issued to G.E. Conover, on Apr. 8, 1969, which is incorporated herein by reference fully as if set forth herein.

As shown in FIG. 3*a*, upper collar 47 is coupled at its upper end to casing 62 at threaded connection 68. At its lower end, upper collar 47 is coupled to mandrel 67 at threaded connection 69. Together, external casing packer 51 and casing 62 define a central bore of substantially uniform diameter. In other words, upper collar 47 and mandrel 67 define a central packer bore 71 which is substantially similar in shape and diameter to central packer bore 73. Therefore, the use of external casing packer 51 does not present an impediment to the passage of wireline tools and workstrings downward through casing 63.

As shown in FIG. 3a, workstring 53 is shown disposed in central packer bore 71 and central casing bore 73. Workstring 53 may comprise any conventional workstring, or coiled tubing workstring, which may be used to inflate external casing packer 51. Preferably, workstring 53 comprises a number of workstring segments 75, 77, 79 which are held together by couplings 81, 83. Sealing cups 85, 87, 88, 91 are carried concentrically and exteriorly of workstring 53. As shown in FIGS. 3*a*, and 3*b* each of sealing cups 85, 87, 89, and 91 include a structural support member 93 which is carried in fixed position between couplings 81, 83, 84 and spacer sleeves 97, 99. Preferably, sealing cups 85, 87, 89, 91 each include sealing elements 95 which are adapted for sealingly engaging central packer bore 71 and central casing bore 73. Sealing cups 85, 87, 88, and 91 are conventional prior art devices used to isolate a selected annular region between workstring 53 and casing 63.

In the embodiment shown in FIGS. 3*a*, 3*b*, and 3*c*, workstring segment 77 is equipped with ports 103, 105, 107, 109, which are adapted for use in selectively directing high pressure wellbore fluid from the interior of workstring 53 into annular space 101 which is sealed at its upper and lower ends by sealing cups 85, 87, 89, 91.

The high pressure wellbore fluid is directed through valve intake ports 63, 65 into valve system 111, which is carried within the material which forms upper collar 47 of external casing packer 51. Valve system 111, in turn, operates to selectively direct high pressure fluid from annular space 101 into inflation chamber 113 which is disposed between mandrel 67 and annular inflatable wall 55. In FIGS. 3*a*, 3*b*, and 3*c* the configuration of external casing packer 51, workstring 53, valve system 111, and sealing cups 85, 87, 89, and 91 is suited for inflation of annular inflatable wall 55 radially outward from mandrel 67 in response to the diversion of high pressure wellbore fluids from workstring 53 into inflation chamber 113.

Figure 4A:
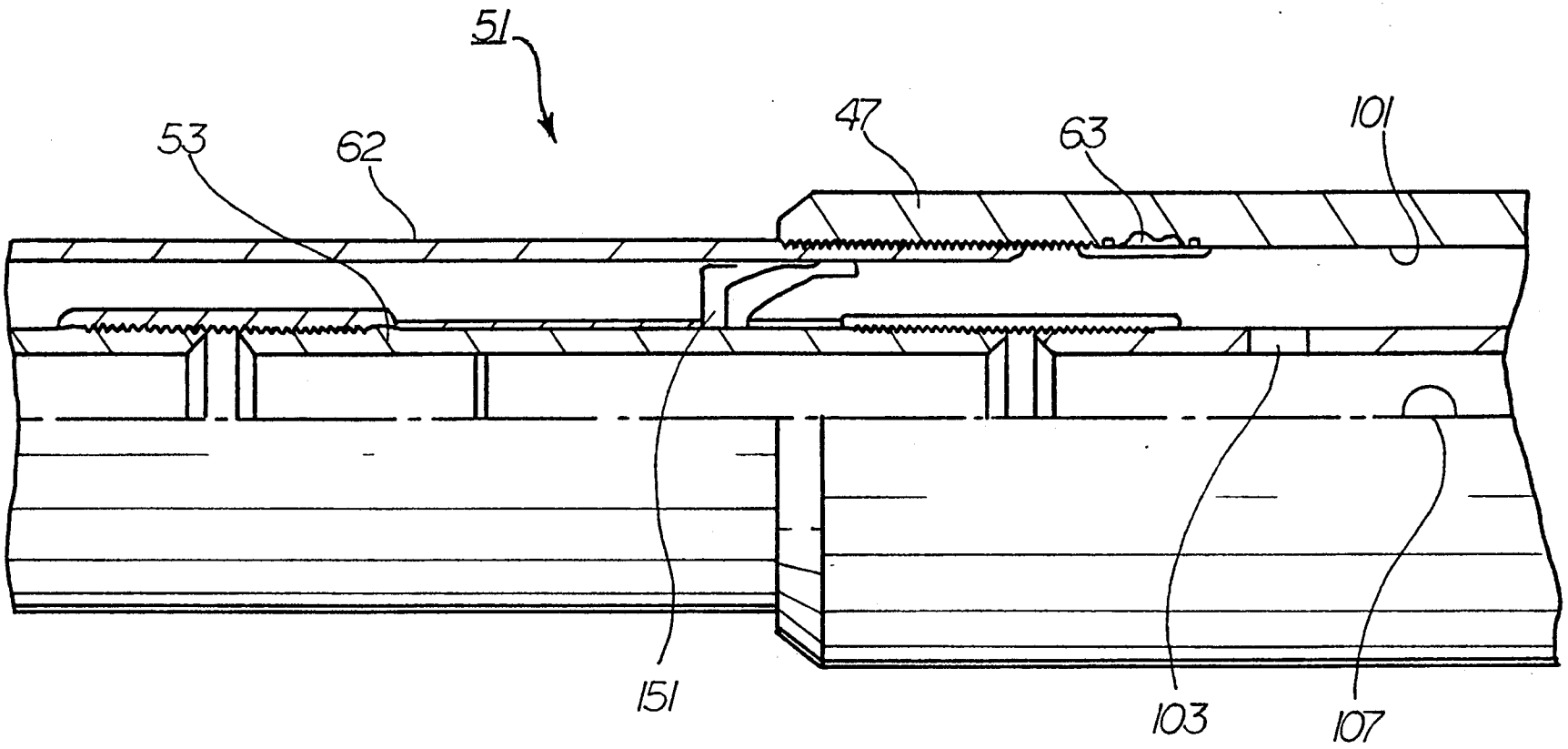
FIG. 4*a*, 4*b*, and 4*c* are one-quarter longitudinal views of the preferred reinflatable external casing packer of the present invention with a workstring disposed therein in a configuration suited for reinflation of the external casing packer during a reinflation mode of operation.
Figure 4B:
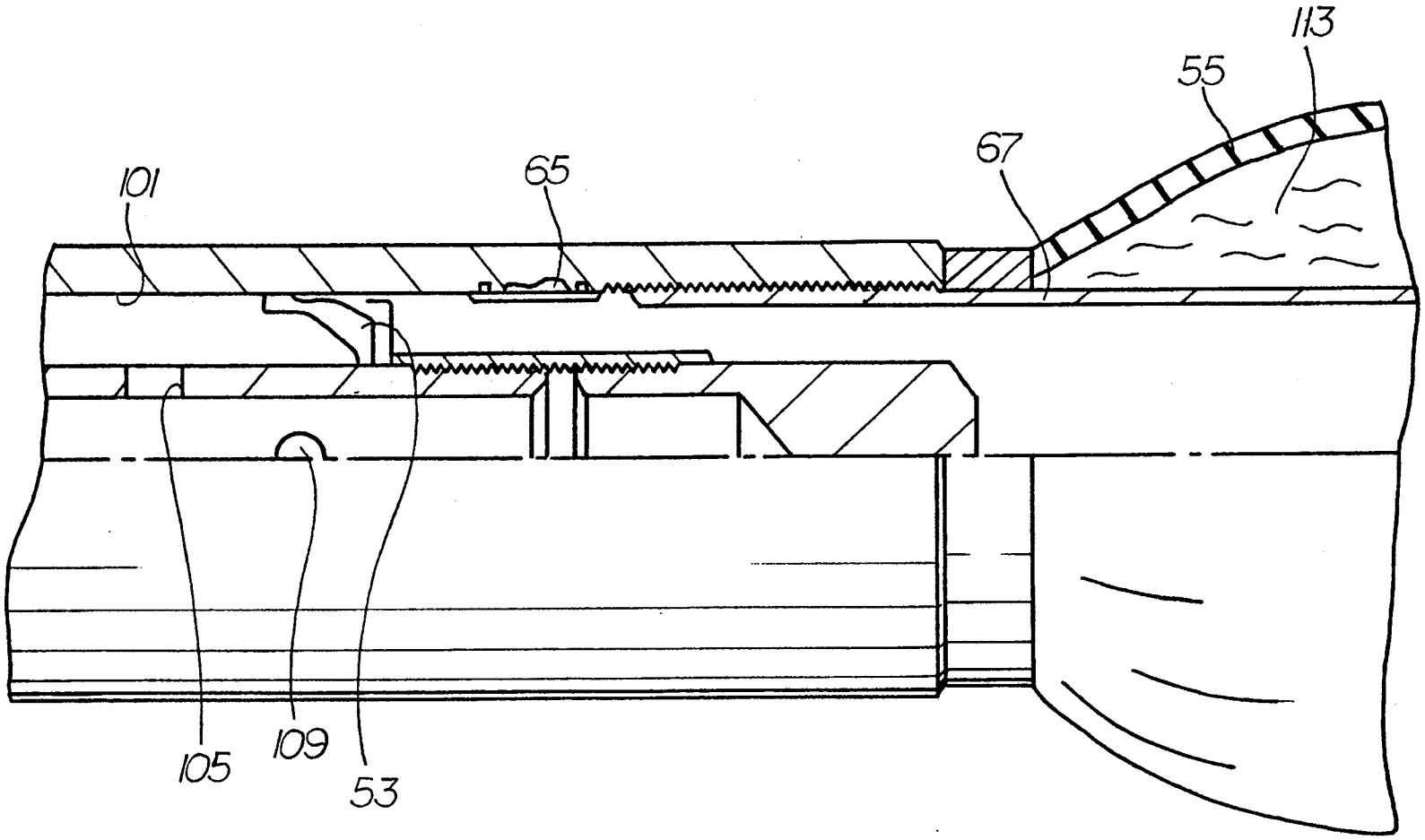
Figure 4D:
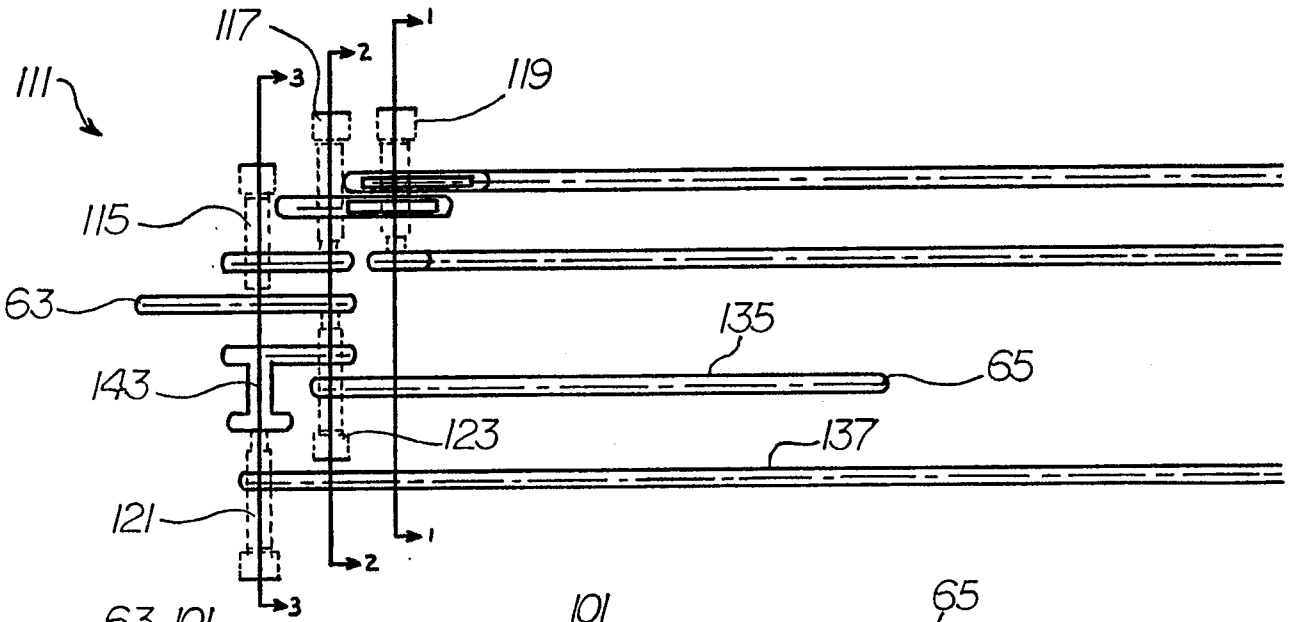
FIG. 4*d* is a schematic view of the valve system of the preferred external casing packer of the present invention.
Figure 4C:
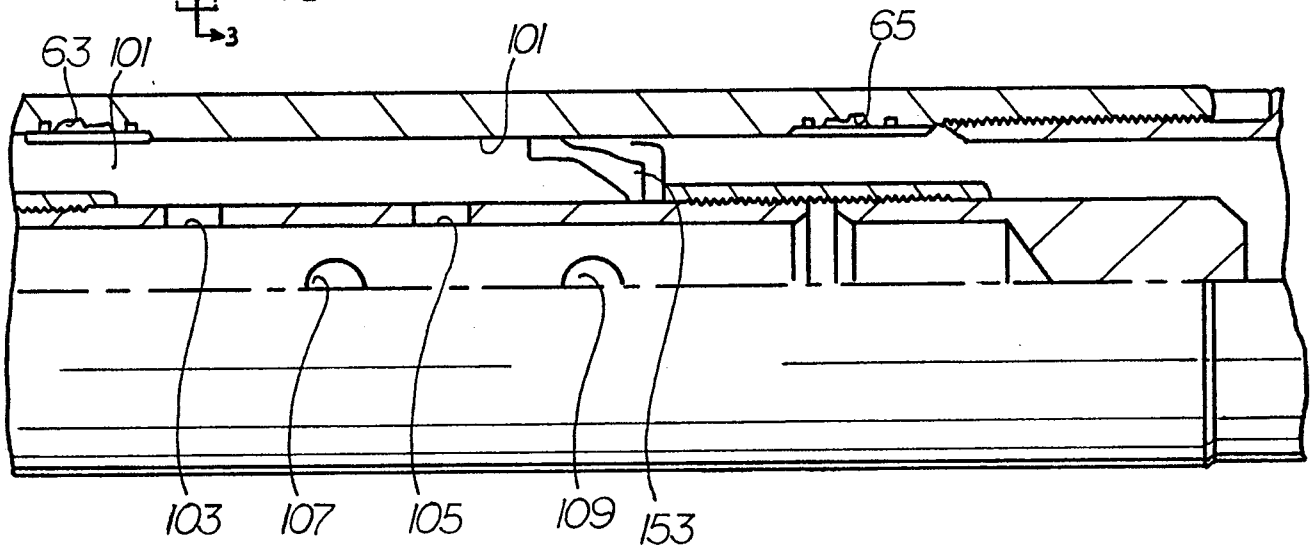

In contrast, FIGS. 4*a*, 4*b*, and 4*c* depicts external casing packer 51 of the present invention in a configuration which is suitable for a reinflation mode of operation in which additional wellbore fluid is directed from annular space: 101, through valve system 111, and into inflation chamber 113. FIGS. 4*a*, 4*b*, and 4*c* be discussed below in detail.

FIG. 3*d* is a schematic view of the valve system 111 of the preferred external casing packer 51 of the present invention. FIG. 3*d* can be considered to be a planar schematic of the radial placement of valves and flow lines within upper collar 47. Valve system 111 is also shown schematically in FIG. 6, which will also be discussed below.

In FIG. 3*d*, five valves are shown in phantom, including: locking shut-off valve 115; check valve 117; inflation limit valve 119; check valve 121; and check valve 123. These valves are coupled together by fluid paths which are formed in the material (preferably steel) which forms upper collar 47 of external casing packer 51 of the present invention, and include fluid flow paths 125, 127, 129, 131, 133, 135, 137, and 143. During an inflation mode of operation, high pressure fluid is received from annular space 101 between workstring 53 and external casing packer 51 at valve intake ports 63, 65, which are identified in both FIGS. 3*a* through 3*c*, and 3*d*. Fluid is directed through the fluid flow paths 125, 127, 129, 131, 133, 135, 137, and 143 of valve system 111 to inflation chamber 113.

In an inflation mode of operation, high pressure fluid is received at valve intake ports 63, 65. Fluid flow path 135 directs fluid from valve intake port 65 to one side of locking shut-off valve 123, while fluid which enters valve intake port 63 is directed to the other side of locking shutoff valve 123. If the pressure levels at valve intake port 63 and valve intake port 65 are substantially equal, then locking shut-off valve 123 remains in its normally-closed position.

However, high pressure fluid is also directed from valve intake port 63, through fluid flow path 125, to locking shut-off valve 115. If the pressure level at valve intake port 63 is sufficiently high (that is, higher than a predetermined pressure threshold), then locking shut-off valve 115 moves from a normally-closed position to an open position, allowing high pressure fluid to flow through fluid flow path 127 to check valve 117. If the fluid pressure level received at check valve 117 is sufficiently high, check valve 117 is moved from a normally-closed position to an open position, allowing fluid to flow through fluid flow path 129 to inflation limit valve 119. If the pressure of the fluid received at inflation limit valve 119 exceeds the pressure level in inflation chamber 113, inflation limit valve 119 remains in its normally-open position and allows the passage of high pressure fluid through fluid flow path 131 into inflation chamber 113. Fluid from inflation chamber 113 is fed back through fluid flow path 133 to inflation limit valve 119. When the pressure within inflation chamber 113 equals the pressure received at inflation limit valve 119, inflation limit valve 119 is urged from its normally-open position to a closed position, to prevent over-inflation of annular inflatable wall 55. This is an important feature, since over-inflation of annular inflatable wall 55 could result in rupture of the inflatable wall permanently damaging external casing packer 51.

As stated above, the configuration of external casing packer 51, workstring 53, and sealing cups 85, 87, 89, and 91, is such that valve intake ports 63, 65 are exposed to an identical pressure level, which prevents locking shut-off valve 123 from moving from a normally-closed position to an open position. This prevents the passage of fluid through locking shut-off valve 123, and check valve 121, and fluid flow path 137. This fluid flow path (through locking shut-off valve 123 and check valve 121) is the fluid flow path employed during a reinflation mode of operation. In fact, the reinflation mode of operation can only be entered when a predetermined pressure differential is obtained between the fluid pressures at valve intake port 63 and valve intake port 65. When workstring 53 and associated sealing cups 85, 87, 89, and 91 are removed from casing 62, valve intake ports 63, 65 will be exposed to substantially identical pressure levels, and the reinflation mode of operation will thus not be entered into accidentally. It is only when a substantial fluid pressure differential is developed between valve intake port 63 and valve intake port 65 that the reinflation mode of operation is entered.

After inflation chamber 113 is fully inflated, and the fluid contained therein is at a pressure level equivalent to the pressure level in annular space 101, inflation limit valve 119 moves from a normally-open position to a closed position to prevent rupture of the annular inflatable wall 55. In addition, locking shut-off valve 115 operates to become permanently lodged in a dosed position, thus preventing accidental and additional inflation of annular inflatable wall 55 through subsequent pressure surges which occur in the wellbore, but which are not intended to act upon external casing packer 51.

FIGS. 4*a*, 4*b*, and 4*c* are one-quarter longitudinal section views of the preferred reinflatable external casing packer 51 of the present invention with workstring 53 disposed therein in a configuration different from that shown in FIGS. 3*a*, 3*b*, and 3*c*, and are especially suited for reinflation of the external casing packer 51 in a reinflation mode of operation. The two exceptions, external casing packer 51, and workstring 53 are identical to those shown in FIG. 3*a*, 3*b*, and 3*c*. The first exception is that workstring 53 is equipped with sealing cups 151, 153, which are spaced closer together than sealing cups 85, 87, 89, and 91 of FIGS. 3*a*, 3*b*, and 3*c* so that valve intake port 63 alone is exposed to high pressure fluid in annular space 101, while valve intake port 65 is not so exposed to high pressure fluid. In other words, a pressure differential is developed between valve intake port 63 and valve intake port 65. The other difference is that annular inflatable wall 55 is extended radially outward from mandrel 67 by fluid which is trapped in inflation chamber 113. In a reinflation mode of operation, high pressure wellbore fluid is directed downward within the wellbore through workstring 63, and is forced outward through ports 103, 105, 107, and 109 into annular space 101. High pressure fluid is then received at valve intake port 63 and directed into valve system 111.

FIG. 4*d* is a schematic view of valve system 111 of the preferred external casing packer 51 of the present invention. As stated above, when annular inflatable wall 55 is fully inflated with fluid which fills inflation chamber 113, locking shut-off valve 115 is urged into a permanently-closed position, thus preventing the reentry of fluid through check valve 117 and inflation limit valve 119 into inflation chamber 113. However, fluid can flow from valve intake port 63 to inflation chamber 113 through locking shut-off valve 123 and check valve 121. This is possible since a pressure differential exists between valve intake port 63 and valve intake port 65, which urges normally-closed locking shut-off valve 123 into an open position to allow passage of fluid through fluid flow path 143 into check valve 121. The pressure differential between valve intake port 63 and inflation chamber 113 operates to move check valve 121 from a normally-closed position to an open position to allow fluid to enter inflation chamber 113 through fluid flow passage 137 to reinflate annular inflatable wall 55.

Valve system 111 of the present invention is designed to prevent accidental reinflation of annular inflatable wall 55, since it is highly unlikely that valve intake port 63 and valve intake port 65 will be exposed to differing pressure levels by accident, since they are close in proximity to one another. It is only through the use of an isolation tool, like workstring 53 and sealing cups 151, 153 that a reinflation mode of operation can be entered.

Figure 5A:
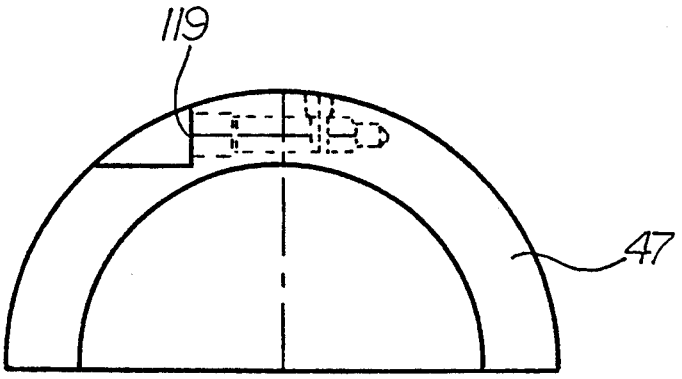
FIGS. 5*a*, 5*b*, and 5*c* are partial cross-section views as seen from lines 1—1, 2—2, 3—3 respectively of FIGS. 3*d* and 4*d;*
Figure 5B:
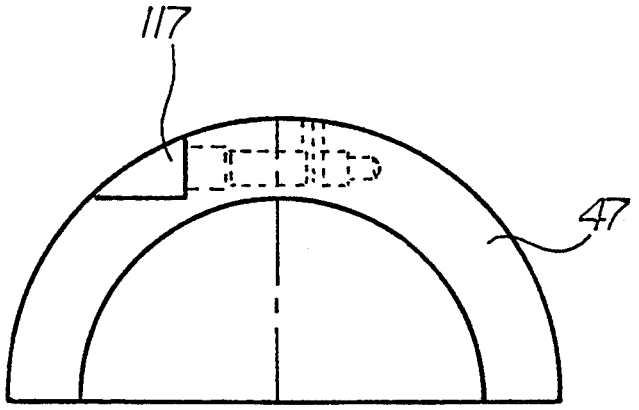
Figure 5C:
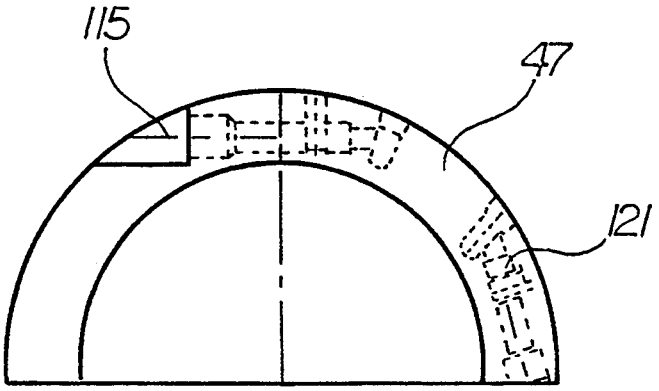

FIGS. 5*a*, 5*b*, and 5*c* are partial cross-section views as seen from lines 1—1, 2—2, and 3—3 respectively of FIGS. 3*d* and 4*d*. These figures are provided to show how valves 115, 117, 119, and 121 are disposed within upper collar 47 of external casing packer 51. As shown in the figures, the valves are adapted to be secured within cavities which extend into the material which forms the body of upper collar 47. Preferably, the valves are threaded, and can be replaced with ease, since they are accessible from the exterior of upper collar 47.

Figure 6:
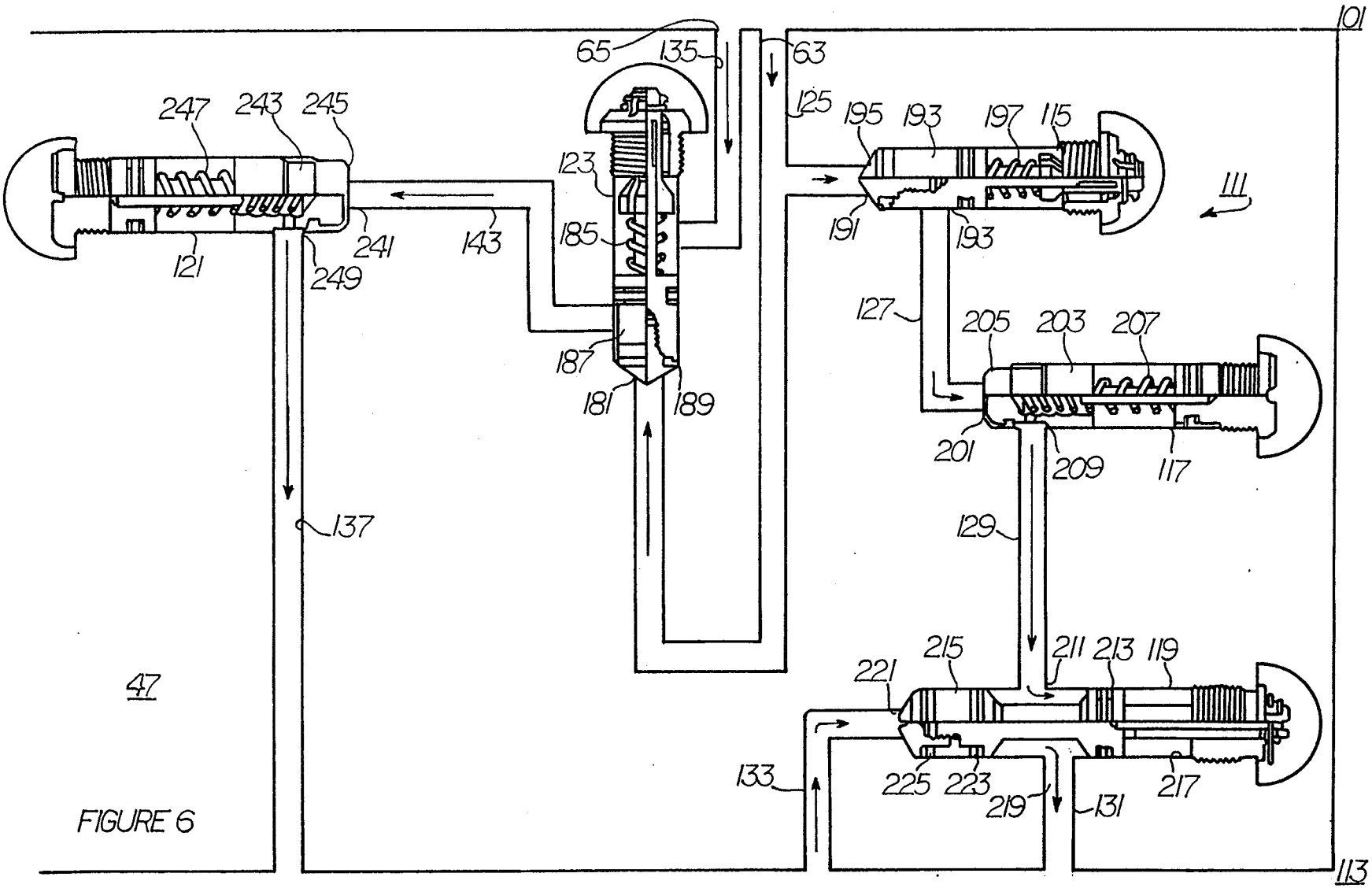
FIG. 6 is a schematic representation of the check valves, inflation limiting valve, and locking shut-off valve, of the valve system of the preferred embodiment of the reinflatable external casing packer of the present invention.

FIG. 6 is schematic representation of the check valves 117, 121, inflation limit valve 119, and locking shut-off valves 115, 123, of the valve system 111 of the preferred embodiment of reinflatable external casing packer 51 of the present invention. As shown, one side of the drawing is representative of annular space 101, and the other side of the drawing is representative of inflation chamber 113. Upper collar 47 includes valve system 111 disposed therein. Fluid is received from annular space 101 through either valve intake port 63, or valve intake ports 63, 65, depending upon the mode of operation, and the configuration of sealing cups which are carried by workstring 53 (of FIGS. 3*a*, 3*b*, 3*c*, 4*a*, 4*b*, and 4*c*).

During an inflation mode of operation, both valve intake port 63 and valve intake port 65 are in fluid communication with annular space 101, and are thus exposed to identical pressure levels. Fluid flow path 125 directs high pressure fluid to input 181 of locking shut-off valve 123, while fluid flow path 135 directs the fluid having the same pressure level to input 183 of locking shut-off valve 123. Within locking shut-off valve 123, spring 185 serves to bias valve head 187 into sealing engagement with valve seat 189. The pressure of fluid received from valve intake port 65 is directed to a position rearward of valve head 187, and acts to supplement the force of spring 185 which urges valve head 187 into sealing engagement with valve seat 189. Only when a significant pressure differential between valve intake port 63 and valve intake port 65 exists, can valve head 187 be moved rearward out of sealing engagement with valve seat 189. The force applied through fluid at input 181 must be greater than the combined force of spring 185 and the fluid pressure of valve intake port 65. In an inflation mode of operation, equal amounts of pressure are applied to locking shut-off valve 123, so valve head 187 remains sealingly mated against valve seat 189.

In an inflation mode of operation, fluid pressure from valve intake port 63 is also directed to locking shut-off valve 115. Specifically, pressurized wellbore fluid is directed from valve intake port 63 through fluid flow path 125 to input 191 of locking shut-off valve 115. Locking shut-off valve 115 includes valve head 193 which sealingly engages valve seat 195 in response to downward bias of valve head 193 by spring 197. When the force of the fluid pressure at input 191 exceeds the force of spring 197, valve head 193 will move out of sealing engagement with valve seat 195, and allow passage of fluid through locking shut-off valve 115, and outward through output 193.

Fluid is then directed via fluid flow path 127 into input 201 of check valve 117. Check valve 117 includes valve head 203 which is urged downward into sealing engagement with valve seat 205 by spring 207. Once the force of fluid at input 201 exceeds the force of spring 207, the valve head 203 is urged backward out of sealing engagement with valve seat 205 to allow fluid to pass through check valve 117 and outward via output 209.

Fluid is then directed via fluid flow path 129 to first input 211 of inflation limit valve 119. As stated above, inflation limit valve is a normally-open valve which remains in a normally-open position until the fluid pressure level of fluid within inflation chamber 113 exceeds the pressure level at first input 211. As shown, inflation limit valve 119 includes upper and lower valve heads 113, 115 would sealingly engage the valve cylinder 217. A fluid flow path is provided between upper and lower valve heads 213, 215 to allow fluid to flow from first input 211 to output 219. The second input 221 is provided below lower valve head 215, and acts solely upon lower valve head 215. O-ring seals 223, 225 are disposed in spaced-apart locations along lower valve head 215. As the pressure within inflation chamber 113 increases, lower valve head 215 is urged upward within valve cylinder 217, until O-ring seals 223, 225 straddle first input 211, and prevent the further passage of fluid through inflation limit valve 119.

Once inflation chamber 113 is completely filled, and annular inflatable wall 55 is in gripping and sealing engagement with openhole wellbore 13, a pressure-surge of a predetermined level may be provided to lock locking shut-off valve 115 into a permanently-closed position, thus closing off a flow path for inflation of external casing packer 51, to prevent leakage of fluid from external casing packer 51, and to prevent the accidental and unintentional over-inflation of external casing packer 51 by accidental pressure surges within the casing 62.

As discussed above, once external casing packer 51 is fully inflated, it is possible for the elastomeric material which forms at least a part of annular inflatable wall 55 to "cold flow" and result in a loss or reduction of the gripping and sealing engagement between external casing packer 51 and openhole wellbore 13. Alternately, it is possible for tiny leak paths to develop in annular inflatable wall 55 or valve system 111, which result in a diminishment of the fluid pressure within inflation chamber 113, and a loss or reduction of the gripping and sealing engagement between external casing packer 51 and openhole wellbore 13. Either event is potentially catastrophic for the oil and gas well, since casing 62 can slip or fall within openhole wellbore 13, and cause irreparable injury. Accordingly, the preferred external casing packer 51 of the present invention is equipped with additional valving components which allow for the entry of a reinflation mode to supplementally inflate external casing packer 51 at a later time, in response to detected or suspected loss of pressure in external casing packer 51, and corresponding loss of gripping and sealing engagement between external casing packer 51 and openhole wellbore 13.

As discussed above, in the reinflation mode of operation, a pressure differential is developed between valve intake port 63, and valve intake port 65. This is accomplished by using a workstring 53 which is equipped with sealing cups 151, 153, which are adapted to isolate valve intake port 63 for application of high pressure fluids thereto. As discussed above, the pressure differential developed between valve intake port 63, and valve intake port 65 allows locking shut-off valve 123 to be moved from a normally-closed position to an open position, wherein valve head 187 is moved out of sealing engagement with valve-seat 189, allowing the passage of fluid from valve intake port 63 through locking shut-off valve 123, and into fluid flow passage 143. Pressurized fluid is then directed to input 241 of check valve 121. Check valve 121 includes a valve head 243 which is biased into sealing engagement with valve seat 245 by spring 247. Like all check valves, check valve 121 operates to allow the passage of fluid in one direction only. Only when the fluid pressure at input 241 exceeds the fluid pressure at output 249 does valve head 243 come out of sealing engagement of valve seat 245, and allow the passage of fluid therethrough. The pressure differential between input 241 and output 249 must also overcome the bias of spring 247. Thus, check valve 121 prevents the unintended deflation of external casing packer 51 during an attempted reinflation. Fluid that has passed through check valve 121 is routed through fluid flow passage 137 to inflation chamber 113 to further inflate annular inflatable wall 55, and urge external casing packer into renewed or enhanced engagement of openhole wellbore 13.

FIGS. *7a* through *7e* depicts in schematic form the method steps of casing an openhole wellbore 13, according to the present invention. When characterized as a method, the present invention comprises a method of casing a wellbore which includes a number of steps. As shown in FIG. *7a*, a plurality of tubular casing string members 281, 283 are provided and coupled in a string with a plurality of inflatable external casing packers 285, 287.

Each of the inflatable packer elements includes a mandrel which defines a central packer bore, having an internal mandrel diameter substantially similar to the internal casing diameter of the tubular casing members. An inflatable wall is disposed exteriorly of the mandrel and at least in-part defines an inflation chamber. A valve system is provided for selectively directing a pressurized fluid from the central packer bore of the mandrel to the inflation chamber.

Figure 7A:
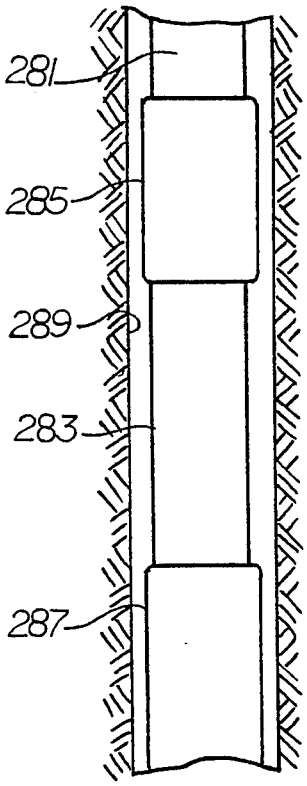
FIGS. 7*a* through 7*e* depict, in schematic form, the method steps of casing an openhole wellbore according to the present invention.
Figure 7B:
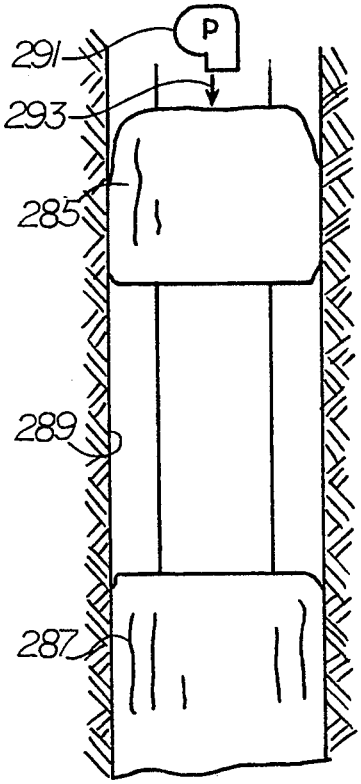

Each inflatable packer is operable in a plurality of modes, including a filling mode, a locking mode, and a reinflation mode. During the filling mode of operation, the valve system directs pressurized fluid into the inflation chamber to outwardly radially expand the inflatable wall from a running position in which the inflatable wall is out of contact with the wellbore surface to a setting position in which the inflatable wall is in a gripping and sealing engagement with the wellbore surface. FIG. 7*a* shows the external casing packers 285,287 in a deflated running position, in which the inflatable walls are out of contact with the wellbore surface 289. FIG. 7*b* shows inflatable external casing packers 285, 287 in a setting position with inflatable walls in gripping and sealing engagement with wellbore surface 289. The filling of inflatable external casing packers 285, 287 is accomplished by using pump 291 to direct wellbore fluid 283 into the respective inflation chambers of the inflatable external casing packers 285, 287.

In a locking mode of operation, the valve system closes to prevent the entry and release of pressurized fluid from the inflation chamber, to prevent damage to the inflatable wall from over-inflation, and to maintain the setting position with the inflatable wall in gripping and sealing engagement with the wellbore surface.

Figure 7C:
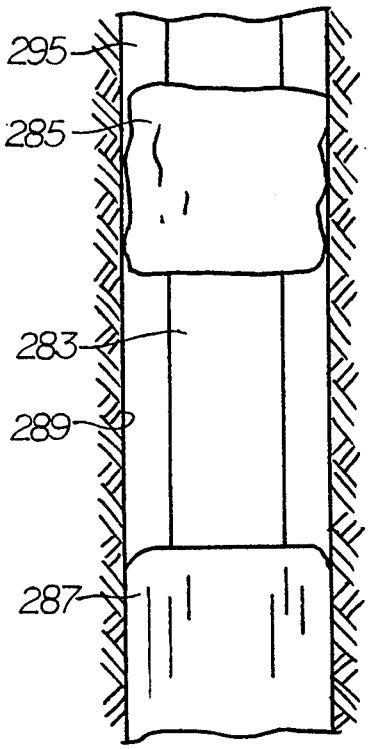

As shown in FIG. 7*c*, one or more inflatable external casing packer may deflate over time to come out of gripping and sealing engagement with wellbore wall 289. As shown, inflatable external casing packer 285 has deflated substantially, and is no longer in gripping and sealing engagement with wellbore wall 289. In fact, a gap 295 exists between inflatable external casing packer 285 and openhole wellbore 289. As a result, inflatable external casing packer 287 must support a greater load than previously anticipated, and may slip or rotate within wellbore 289, causing damage to the well and equipment therein.

Figure 7D:
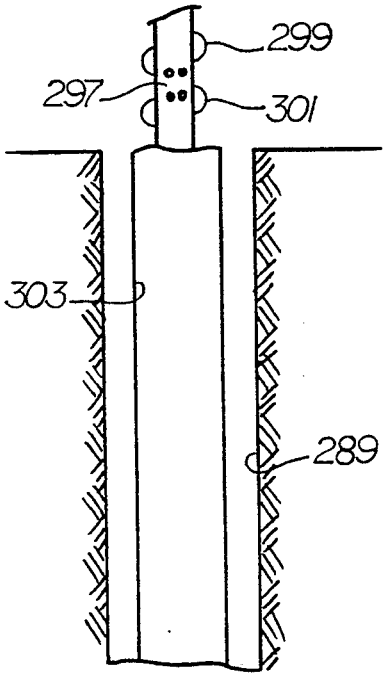
Figure 7E:
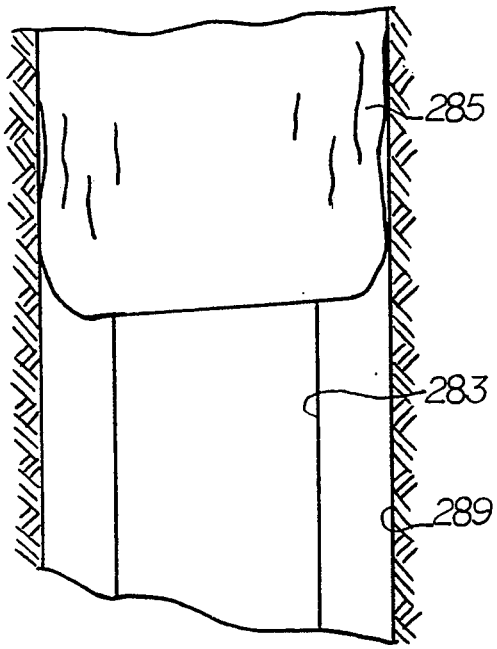

In the present invention, the inflatable external casing packer 285 is also operable in a reinflation mode of operation, wherein the locking mode is overridden and pressurized fluid is directed into the inflation chamber to compensate the loss of pressure in the inflation chamber. As shown in FIG. 7*d*, workstring 297 carries isolation members 299, 301, and is lowered downward into wellbore 289 through casing 303. As discussed above, isolation members 299, 301 operate to isolate one or more input ports in the valving system carded by selected inflatable external casing packers. As shown in FIG. 7*e*, inflatable external casing packer 285, which was previously deflated, can be selectively reinflated into gripping and sealing engagement with openhole wellbore wall 289.

The external casing packer and method of casing of the present invention have many distinct advantages over prior art devices and methods. One significant advantage is that the external casing packer allows a casing string to be set as permanently as with any other prior art external casing packer. For example, pressure surges within the wellbore cannot inadvertently operate to inflate or deflate the external casing packer, since the packer valve system locks after full inflation of the packer. Another significant advantage of the present invention is that the external casing packer includes a means which allows for selective reinflation of the packer, when leakage or cold flowing of the elastomeric members is suspected or detected. The reinflation mode of operation is entered only when a pressure differential is developed between intake ports of the valve system. Consequently, inadvertent reinflation or over-inflation of the external casing packer is unlikely. Only with the use of a special tool which is lowered within the casing string can the reinflation mode of operation be entered. Thus, the existence of a reinflation mode of operation presents no problems to the long range stability and permanence of the external casing packer, but provides all the advantages of being able to supplementally inflate the external casing packer to counterbalance leakage or cold flow problems.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. A method of casing an openhole wellbore, comprising the steps of:

providing a tubular casing string, which defines a central casing bore having an internal casing diameter, for placement in said openhole wellbore;

providing at least one inflatable packer which includes a mandrel which defines a central packer bore having an internal mandrel diameter substantially similar to said internal casing diameter of said tubular casing string, an inflatable wall disposed exteriorly of said mandrel and at least in-part defining an inflation chamber disposed exteriorly of said mandrel, and a valve system for selectively directing pressurized fluid from said central packer bore of said mandrel to said inflation chamber;

coupling said at least one inflatable packer in said tubular casing string;

placing said tubular casing string and said at least one inflatable packer in a selected location within said openhole wellbore;

directing a wellbore fluid through said valve system of said at least one inflatable packer and into said inflation chamber;

inflating, with said wellbore fluid, said inflatable wall of said at least one inflatable packer radially outward from said mandrel into at least a sealing engagement with said openhole wellbore;

closing said valve system of said at least one inflatable packer to prevent further inflation of said inflatable wall;

lowering a wellbore tool into said wellbore and within said tubular casing string to a position for reinflating said at lease one inflatable packer; and selectively directing wellbore fluid through said valve system of said at least one inflatable packer to reinflate said inflatable wall of said inflatable packer.

2. A method of casing according to claim 1, whereto said tubular casing string is maintained in a fixed position relative to said openhole wellbore solely through said sealing engagement of said openhole wellbore by said inflatable wall of said at least one inflatable packer.

3. A method of casing according to claim 1, wherein, in said step of selectively directing, said wellbore tool is lowered within said casing bore of said tubular casing string in a location proximate said at least one inflatable packer for directing said wellbore fluid to said valving system and into said at least one inflatable packer in response to a pressure differential across said central packer bore within said mandrel.

4. A method of casing according to claim 1, wherein said step of closing said valving system includes locking said valving system in a closed position to prevent inadvertent inflation of said at least one inflatable packer.

5. A method of casing according to claim 1, wherein said valving system is responsive to pressure of said wellbore fluid within said tubular casing string, and wherein said step of closing said valve system includes locking said valve system in a closed position in response to said wellbore fluid obtaining a preselected pressure level within said tubular casing string.

6. A method of casing according to claim 1, wherein said step of selectively directing includes selectively opening said valve system by obtaining a preselected pressure differential within said tubular casing string to allow wellbore fluid to be directed into said inflation chamber.

7. The method of casing an openhole wellbore according to claim 1, further comprising the steps of:

coupling a plurality of said inflatable packers in said tubular casing string;

placing said plurality of inflatable packers within said wellbore at different wellbore depths when placing said tubular casing string and said at least one inflatable packer in said selected location within said openhole wellbore; and separately inflating each of said plurality of inflatable packers at different times for selectively isolating different productive intervals within said wellbore.

8. A method of casing a wellbore, comprising the steps of:

providing a tubular casing string, which defines a central casing bore having an internal casing diameter, for placement in said wellbore;

providing at least one inflatable packer which includes a mandrel which defines a central packer bore having an internal mandrel diameter substantially similar to said internal casing diameter of said tubular casing string, an inflatable wall disposed exteriorly of said mandrel and at least in-part defining an inflation chamber, and a valve system for selectively directing a pressurized fluid from said central packer bore of said mandrel to said inflation chamber;

wherein said at least one inflatable packer is operable in a plurality of modes, including:

a filling mode, wherein said valve system directs said pressurized fluid into said inflation chamber to outwardly radially expand said inflatable wall from a running position in which said inflatable wall is out of contact with a wellbore surface to a setting position in which said inflatable wall is in a sealing engagement with said wellbore surface;

a locking mode, wherein said valve system closes to prevent the entry and release of said pressurized fluid from said inflation chamber to prevent damage to said inflatable wall from over-inflation and to maintain said setting position with said inflatable wall in sealing engagement with said wellbore surface; and a reinflation mode, wherein said locking mode is overridden and said pressurized fluid is directed into said inflation chamber to compensate for loss of pressure in said inflation chamber;

coupling said at least one inflatable packer in said tubular casing string;

placing said tubular casing string and said at least one inflatable packer in a selected location within said wellbore;

directing said pressurized fluid from said central casing bore, through said valve system during said filling mode of operation, and into said inflation chamber of said at least one inflatable packer, to inflate said at least one inflatable packer;

inflating said inflatable wall of said at least one inflatable packer radially outward from said mandrel and into sealing engagement with said wellbore;

automatically closing said valve system into said locking mode of operation when a preselected pressure level is obtained in said inflation chamber of said at least one inflatable packer to simultaneously prevent over-inflation of said inflatable wall and deflation of said inflatable wall; and selectively directing, during said reinflation mode of operation, said pressurized fluid through said valve system of said at least one inflatable packer to override said locking mode of operation and reinflate said inflatable wall.

9. A method of casing a wellbore according to claim 8, wherein said valve system includes a plurality of input ports in communication with said pressurized fluid and wherein said reinflation mode is entered only upon application of a preselected pressure differential of said pressurized fluid across said plurality of input ports.

10. A method of casing a wellbore according to claim 8, wherein said valve system includes first and second input ports in communication with said pressurized fluid and wherein said reinflation mode is entered only upon application of differing preselected levels of pressure of said pressurized fluid to said first and second input ports.

11. A method of casing a wellbore according to claim 8, wherein said valve system includes a plurality of input ports in communication with said pressurized fluid and wherein a selection between modes of operation is accomplished by applying preselected levels of pressure of said pressurized fluid to said plurality of input ports.

12. The method of casing a wellbore according to claim 8, further comprising the steps of:

coupling a plurality of said inflatable packers in said tubular casing string;

placing said plurality of inflatable packers within said wellbore at different wellbore depths when placing said tubular casing string and said at least one inflatable packer in said selected location within said openhole wellbore; and separately inflating each of said plurality of inflatable packers at different times for selectively isolating different productive intervals within said wellbore.

13. The method of casing a wellbore according to claim 8, further comprising the step of:

lowering a wellbore tool into said wellbore and within said tubular casing string to a position proximate said inflatable packer for sealing across said central packer bore; and selectively applying a pressure differential across said wellbore tool and across said central packer bore for urging said at least one inflatable packer into said reinflation mode of operation and reinflating said at lease one inflatable packer.

14. The method of casing a wellbore according to claim 8, wherein said wellbore surface is an openhole wellbore surface.

15. A method for use within a wellbore to seal between a wellbore surface and a tubular conduit for preventing a fluid flow therebetween, said method comprising the steps of:

securing an inflatable packer about said tubular conduit;

lowering said inflatable packer and said tubular conduit downhole within said wellbore to position said inflatable packer and said tubular conduit adjacent to said wellbore surface;

passing an inflation fluid through a central bore of said tubular conduit and into said inflatable packer for urging said inflatable packer to sealingly engage between said tubular conduit and said wellbore surface to prevent said fluid flow therebetween;

sealing said inflation fluid within said inflatable packer for preventing further inflation of said inflatable packer and for urging said inflatable packer to continue sealingly engaging between said tubular conduit and said wellbore surface; and reinflating said inflatable packer by passing said inflation fluid into said inflatable packer in response to cooperatively applying a fluid pressure and a fluid pressure differential within said central bore of said tubular member.

16. The method according to claim 15, further comprising the steps of:

coupling a plurality of said inflatable packers in said tubular casing string;

lowering said plurality of inflatable packers within said wellbore at different wellbore depths when lowering said inflatable packer and said tubular conduit adjacent to said wellbore surface for placing said plurality of inflatable packers at said selected positions within said wellbore; and separately inflating each of said plurality of inflatable packers at different times for selectively isolating different productive intervals within said wellbore.

17. The method according to claim 15, wherein said wellbore surface is a surface of an openhole wellbore, and said inflatable packer and said tubular conduit are included within a casing string.

18. The method according to claim 15, wherein said wellbore surface is an interior surface of a first casing string, and said inflatable packer and said tubular conduit are included within a second casing string which provides a production liner within said first casing string.

19. The method according to claim 15, further comprising the steps of:

applying a fluid pressure within a central bore of said inflatable packer for passing said inflation fluid into said inflatable packer and urging an initial inflation of said inflatable packer;

lowering a reinflation tool within said central bore of said tubular conduit for sealing across said central bore proximate to said inflatable packer; and applying a differential fluid pressure across said reinflation tool for applying said differential fluid pressure across said central bore to urge reinflation of said inflatable packer.

20. An apparatus for casing a wellbore to prevent a wellbore fluid from flowing between a tubular conduit and a wellbore surface, said apparatus comprising:

an inflatable packer secured about said tubular conduit for lowering to a selected position within said wellbore and inflating to sealingly engage said wellbore surface for preventing said wellbore fluid from flowing between said tubular conduit and said wellbore surface;

a valving assembly for controlling an inflation fluid flow from a central bore of said tubular conduit into said inflatable packer to control inflation of said inflatable packer;

said valving assembly operable for locking a fluid pressure within said inflatable packer, and for locking said inflation fluid flow out of said inflatable packer to prevent further inflation in response to a transient pressure within said central bore; and said valving assembly further operable for reinflating said inflatable packer in response to a pressure differential within said central bore of said tubular conduit which is applied across said valving assembly.

21. The apparatus for casing a wellbore of claim 20, wherein said wellbore surface is a surface of an openhole wellbore, and said inflatable packer and said tubular conduit are included within a casing string for sealing within said openhole wellbore to prevent said wellbore fluid from flowing therein.

22. The apparatus for casing a wellbore of claim 20, wherein said wellbore surface is an interior surface of a first casing string, and said inflatable packer and said tubular conduit are included within a second casing string which provides a production liner within said first casing string.

23. The apparatus for casing a wellbore of claim 20, further comprising:

a plurality of intake ports for passing said inflation fluid to inflate and reinflate said inflatable packer, and for passing said pressure differential within said valving assembly for allowing reinflation of said inflatable packer in response to a wellbore tool applying said pressure differential within said central bore of said tubular conduit and across said plurality of intake ports.

24. The apparatus for casing a wellbore of claim 20, wherein said valving assembly comprises:

a first member having a first and second fluid flowpaths separately extending from said central bore of said tubular conduit for separately transferring, at least in part, said pressure differential which is selectively applied within said central bore between said first and second fluid flowpaths;

a second member movably secured about said first member and extending between said first and second fluid flowpaths for selectively moving between a plurality of positions for selectively obstructing said fluid flow from said central bore in response to said pressure differential separately transferred from said central bore to said second member by said first and second fluid flowpaths; and wherein said pressure differential, at least in part, urges said second member to move for selectively obstructing, and thus controlling, said fluid flow from said central bore of said wellbore tool.

25. The apparatus of claim 24, wherein said pressure differential is directly applied from said central bore of said wellbore tool to said second member by said first and second fluid flowpaths communicating wellbore fluids between said second member and said central bore of said wellbore tool.

26. The apparatus of claim 24, wherein said fluid flow from said central bore of said wellbore tool passes through said first fluid flowpath, and said second member extends into said first fluid flowpath for controlling said fluid flow therein.

* * * * *